US010756463B2

(12) United States Patent
Hiroki et al.

(10) Patent No.: US 10,756,463 B2
(45) Date of Patent: Aug. 25, 2020

(54) FLEXIBLE FLAT CABLE CONNECTOR, FLEXIBLE FLAT CABLE CONNECTION STRUCTURE, AND ROTARY CONNECTOR DEVICE

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Kenji Hiroki, Inukami-gun (JP); Kendy Rodrigo Yamashita, Inukami-gun (JP)

(73) Assignees: FURUKAWA ELECTRIC CO., LTD., Tokyo (JP); FURUKAWA AUTOMOTIVE SYSTEMS INC., Inukami-Gun (JP)

( * ) Notice: Subject to any disclaimer, the term of this patent is extended or adjusted under 35 U.S.C. 154(b) by 0 days.

(21) Appl. No.: 16/198,402

(22) Filed: Nov. 21, 2018

(65) Prior Publication Data

US 2019/0165502 A1 May 30, 2019

Related U.S. Application Data

(63) Continuation of application No. PCT/JP2017/018711, filed on May 18, 2017.

(30) Foreign Application Priority Data

May 23, 2016 (JP) ..... 2016-102039

(51) Int. Cl.

| | |
|---|---|
| ***H01R 13/15*** | (2006.01) |
| ***H01R 12/59*** | (2011.01) |
| ***H01R 35/04*** | (2006.01) |

(52) U.S. Cl.
CPC ..... *H01R 12/59* (2013.01); *H01R 35/04* (2013.01)

(58) Field of Classification Search
CPC ..... H05K 1/117; H05K 3/365; H05K 1/118; H05K 3/3452; H05K 1/189; H01R 12/79; H01R 23/662; H01R 23/684
(Continued)

(56) References Cited

U.S. PATENT DOCUMENTS 4,253,719 A * 3/1981 McGinley ..... H01R 12/721 439/329
4,969,840 A * 11/1990 Ii ..... H01R 12/592 439/352
(Continued)

FOREIGN PATENT DOCUMENTS

CN 1599539 A 3/2005
CN 101473497 A 7/2009
(Continued)

OTHER PUBLICATIONS

International Search Report for PCT/JP2017/018711 (PCT/ISA/210) dated Aug. 8, 2017.
(Continued)

*Primary Examiner* — Thanh Tam T Le
(74) *Attorney, Agent, or Firm* — Birch, Stewart, Kolasch & Birch, LLP

(57) ABSTRACT

Provided is a flexible flat cable connector that can easily connect a flexible flat cable, and provide a reliable connection. An FFC connector (40) has a substantially L-shape in cross section and includes a plurality of busbars (41) made of metal, and a busbar case (42) made of resin and holding the busbars so that part of the plurality of busbars (41) is exposed. The busbar case (42) includes: a recessed portion (44) configured to accommodate an end portion (14*b*) of an
(Continued)

FFC (14); a bottom wall (45) provided on the recessed portion (44); paired side walls (46, 46) each disposed at both ends of the recessed portion (44) and facing each other in the width direction of the FFC (14); a plurality of protruding portions (47A, 47A, . . . ) provided on the bottom wall (45); and paired projections (48, 48) projecting from the paired side walls (46, 46), facing each other, and spaced apart from the bottom wall (45).

17 Claims, 9 Drawing Sheets

(58) Field of Classification Search
USPC ..... 439/55, 67, 77, 492, 495, 497, 260; 174/250; 361/749
See application file for complete search history.

(56) References Cited

U.S. PATENT DOCUMENTS 5,057,037 A * 10/1991 Mouissie ..... H01R 12/592 439/495
5,356,308 A * 10/1994 Toba ..... H01R 13/5219 439/422
5,924,891 A * 7/1999 Benjamin ..... H01R 12/7005 439/495
6,089,905 A * 7/2000 Shimmyo ..... H01R 12/79 439/260
6,244,890 B1 * 6/2001 Fuerst ..... H01R 13/6273 439/352
6,558,186 B1 * 5/2003 LePottier ..... H01R 12/79 439/493
6,755,683 B2 * 6/2004 Roberts ..... H01R 12/79 439/496
6,802,736 B2 * 10/2004 Godefroy ..... H01R 13/4223 439/492
7,134,891 B2 * 11/2006 Kayama ..... H01R 12/88 439/260
7,210,942 B2 * 5/2007 Uchida ..... H05K 3/363 439/67
7,976,328 B2 * 7/2011 Tsai ..... H01R 12/88 439/341
8,133,067 B2 * 3/2012 Tsai ..... H01R 12/79 439/260
8,202,108 B2 * 6/2012 Shen ..... H01R 23/661 439/329
8,939,790 B2 * 1/2015 Jung ..... H01R 12/774 439/495
10,217,545 B2 * 2/2019 Chiou ..... H01B 7/0838
2005/0208824 A1 9/2005 Kayama et al.
2009/0181561 A1 7/2009 Kusaki et al.
2011/0008997 A1 1/2011 Huang et al.
2012/0129400 A1 5/2012 Ohyama
2012/0252252 A1 10/2012 Yamaji
2014/0057462 A1 2/2014 Takahashi

FOREIGN PATENT DOCUMENTS

CN 101510638 A 8/2009
CN 101958476 A 1/2011
CN 103633522 A 3/2014
EP 1052743 A1 11/2000
EP 1083627 A1 3/2001
JP 2002-100425 A 4/2002
JP 2006-12717 A 1/2006
JP 2010-73682 A 4/2010
JP 2012-69478 A 4/2012
JP 2012-209079 A 10/2012
JP 5566831 B2 8/2014
KR 10-0562774 B1 3/2006

OTHER PUBLICATIONS

Written Opinion of the International Searching Authority for PCT/JP2017/018711 (PCT/ISA/237) dated Aug. 8, 2017.
International Preliminary Report on Patentability and English Translation of Written Opinion of the International Searching Authority dated Nov. 27, 2018, issued in PCT/JP2017/018711 (Forms PCT/IB/373 and PCT/ISA/237).
Extended European Search Report for corresponding European Application No. 17802676.1, dated Dec. 10, 2019.
Chinese Office Action and Search Report for corresponding Chinese Application No. 201780031730.X, dated Sep. 4, 2019, with English translation.
Korean Office Action for corresponding Korean Application No. 10-2018-7033855, dated Apr. 17, 2020, with English Machine translation.
Chinese Office Action and Search Report for corresponding Chinese Application No. 201780031730.X, dated May 20, 2020, with English translation.

* cited by examiner 40
42
44b-2
14e
14f
44a
44b-1
48
14d
14c
14b
43
45
50a
47A
49
45a
41 w
47A
40
42
44b-2
14e
14f
44a
44b-1
48
48a
14
43
45
14c
50a
14b
14d
49
45a
41

40
42
44b-2
14f
44a
44b-1
47
47b
48a
48
14
43
45
14c
50a
14b
14d
49
45a
41

S
40
42
44b-2
14f
44a
44b-1
47
48
48a
48b
14
43
45
14c
50a
14b
14d
49
45a
41

FLEXIBLE FLAT CABLE CONNECTOR, FLEXIBLE FLAT CABLE CONNECTION STRUCTURE, AND ROTARY CONNECTOR DEVICE

CROSS REFERENCE TO RELATED APPLICATIONS

This application based on International Patent Application No. PCT/JP2017/0018711 filed May 18, 2017, which claims the benefit of Japanese Patent Applications No. 2016-102039 filed May 23, 2016, the full contents of both of which are hereby incorporated by reference in their entirety.

BACKGROUND

Technical Field

The present disclosure relates to a flexible flat cable connector, a flexible flat cable connection structure, and a rotary connector device including a connection terminal, and in particular, relates to a flexible flat cable connection structure that is connected to an end portion of a flexible flat cable enclosed in a rotary connector device.

Background

In a vehicle such as a four-wheeled automobile, a rotary connector device for supplying electric power to airbag devices or the like is attached to a connecting portion between a steering wheel for steering and a steering shaft. The rotary connector device is attached while surrounding the steering shaft, and a steering column cover is attached so as to enclose the rotary connector device and the end portion of the steering shaft. In addition, in the steering wheel, a steering lower cover is attached so as to enclose the boss portion of the steering wheel.

The rotary connector device includes a stator, a rotator incorporated to the stator in a freely rotatable manner, and a flexible flat cable (FFC) that is wound and accommodated in an annular inner space defined by the stator and the rotator, and the FFC has an end portion provided with a connection structure that electrically connects the FFC and the outside together.

As one of examples of the connection structure described above, a connection structure is disclosed, which includes a plurality of busbars made of metal, and a bulbar case made of resin and holding the busbars so that part of the busbars is exposed, and a plurality of terminal portions where part of the busbar is exposed are configured so as to be able to be electrically connected with a conductor portion of the FFC (Japanese Patent Publication No. 5566831B). The busbar case of this connection structure is provided with a shallow recessed portion having almost the same width as the FFC, and part of the busbars is exposed from the inner surface of this recessed portion to form the terminal portion. In addition, paired inner walls in the recessed portion described above are disposed so as to face each other in the width direction of the FFC, and a mold cover, which is fitted into the busbar case in a detachable manner, is disposed between the paired inner walls. When the FFC is connected to the connection structure, the length direction end portion of the FFC is inserted into the recessed portion of the busbar case, and the mold cover is attached to the busbar case with the position of the FFC being maintained. This enables the FFC to be sandwiched between the inner wall of the recessed portion and the mold cover and can restrict the FFC so that positional shift and flapping do not occur during a subsequent welding process.

Disclosure

However, in the related art described above, the FFC is fixed by placing the FFC on the busbar case serving as a primary mold member, and then, attaching, on top of that, a mold cover serving as a mold cover to dispose the FFC between the busbar case and the mold cover. This requires two members for fixing the FFC. In addition, the connecting process requires two processes including setting the FFC on the busbar case, and attaching the mold cover to the busbar case, resulting in complex operations. In particular, in recent years, the performance and functionalities of automobiles have been enhanced, which leads to an increase in the number of devices and units provided in each automobile, and also leads to a tendency to increase the number of wires in an electric wiring body used in these devices and the like. Meanwhile, weight reduction in each of the devices and the like has been strongly desired in order to increase fuel efficiency of a moving body such as an automobile with environmental consideration taken into account. Thus, even if the size of the rotary connector device is further reduced from the viewpoint of space saving and weight reduction, there is still a demand for a connection structure capable of providing a reliable connection while achieving an easy connection with the FFC An object of the present disclosure is to provide a flexible flat cable connector, a flexible flat cable connection structure, and a rotary connector device, capable of providing a reliable connection while achieving an easy connection with a flexible flat cable.

SUMMARY

According to the present disclosure provides a flexible flat cable connection structure configured to electrically connect a flexible flat cable and the outside together, the flexible flat cable connector including: a recessed portion configured to accommodate an end portion of the flexible flat cable; a bottom wall provided on the recessed portion; paired side walls disposed at both ends of the recessed portion and facing each other in a width direction of the flexible flat cable; a plurality of protruding portions provided on the bottom wall; and paired projections projecting from the paired side walls, facing each other, and spaced apart from the bottom wall.

In addition, the flexible flat cable connector further includes paired notch portions provided in the bottom wall and disposed below the paired projections in a direction perpendicular to an in-plane direction of the flexible flat cable.

In addition, the flexible flat cable connector further includes paired stepped portions provided on the paired side walls and configured to set a position of a corner portion of the flexible flat cable.

The plurality of protruding portions are disposed at asymmetrical positions with respect to a center of the flexible flat cable in a width direction of the flexible flat cable.

According to the present disclosure provides a flexible flat cable connection structure that includes a flexible flat cable and a flexible flat cable connector configured to electrically connect the flexible flat cable and the outside together. The flexible flat cable connector includes: a recessed portion configured to accommodate an end portion of the flexible flat cable; a bottom wall provided on the recessed portion; paired side walls disposed at both ends of the recessed portion and facing each other in a width direction of the flexible flat cable; a plurality of protruding portions provided on the bottom wall and inserted respectively into a plurality of holes provided in the flexible flat cable; and paired projections projecting from the paired side walls, facing each other, and spaced apart from the bottom wall.

The flexible flat cable connection structure further includes a welded portion extending in a width direction of the flexible flat cable and configured to connect an end portion of the flexible flat cable and the bottom wall together. The plurality of protruding portions are disposed closer to the welded portion than the paired projections in a length direction of the flexible flat cable.

The plurality of protruding portions are disposed at asymmetrical positions with respect to a center of the flexible flat cable in a width direction of the flexible flat cable.

In addition, the plurality of protruding portions may have shapes different from each other in a plan view of the bottom wall.

The plurality of protruding portions include a flat expanding portion extending in a width direction of the flexible flat cable.

In addition, there is provided a rotary connector device including the flexible flat cable connector or the flexible flat cable connection structure.

Effects of Disclosure

According to the present disclosure, the plurality of protruding portions are provided on the bottom wall of the recessed portion. The paired projections project from the paired side walls, face each other, and are spaced apart from the bottom wall. Thus, the plurality of protruding portions are caused to pass through a plurality of holes provided in the flexible flat cable, and both width-direction end portions of the flexible flat cable are incorporated between the bottom wall and the paired projections. With this configuration, movement of the flexible flat cable in the length direction is restricted by the plurality of protruding portions, movement of the flexible flat cable in the lateral direction is restricted mainly by the plurality of protruding portions, and movement of the flexible flat cable in the thickness direction is restricted mainly by the paired projections. Thus, this configuration does not require two members, and hence, a reduction in the number of parts can be achieved. In addition, the flexible flat cable can be fixed only by using one member, that is, the flexible flat cable connector. Furthermore, multiple steps in association with the two-member configuration are not necessary, and hence, fixing can be performed only through a series of simple steps. Thus, it is possible to easily connect the flexible flat cable while providing a reliable connection.

BRIEF DESCRIPTION OF DRAWINGS

FIGS. 2A and 2B are perspective views illustrating the configuration of the flexible flat cable connection structure illustrated in FIG. 1, in which FIG. 2A illustrates a state where a flexible flat cable is connected to a flexible flat cable connector, and FIG. 2B illustrates a state before the flexible flat cable is connected.

FIGS. 3A and 3B are diagrams illustrating the configuration of the flexible flat cable connector illustrated in FIG. 2B, in which FIG. 3A is a plan view and FIG. 3B is a bottom view.

FIGS. 4A and 4B are diagrams illustrating the configuration of the flexible flat cable connector illustrated in FIG. 2B, in which FIG. 4A is a front view and FIG. 4B is a rear view.

FIGS. 5A and 5B are diagrams illustrating the configuration of the flexible flat cable connector illustrated in FIG. 2B, in which FIG. 5A is a left-side view and FIG. 5B is a right-side view.

FIGS. 7A and 7B are diagrams illustrating details of the protruding portions in the flexible flat cable connection structure illustrated in FIG. 2B, in which FIG. 7A is a perspective view and FIG. 7B is a plan view illustrating a modification example of the protruding portions.

DETAILED DESCRIPTION

Hereinbelow, embodiments according to the present disclosure will be described in detail with reference to the drawings.

Figure 1:
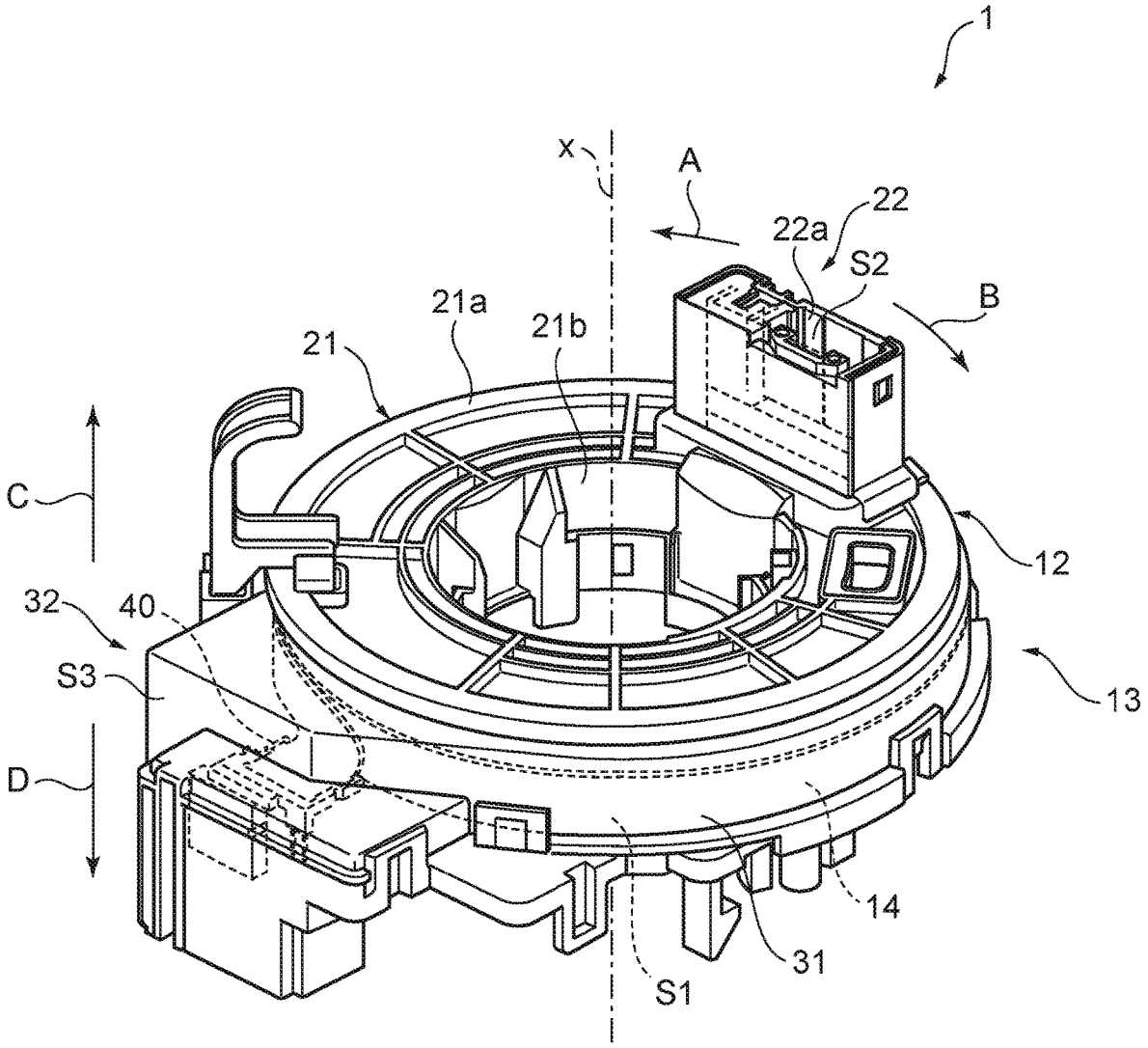
FIG. 1 is a perspective view schematically illustrating a rotary connector device that includes a flexible flat cable connection structure according to an embodiment of the present disclosure.
Figure 2A:
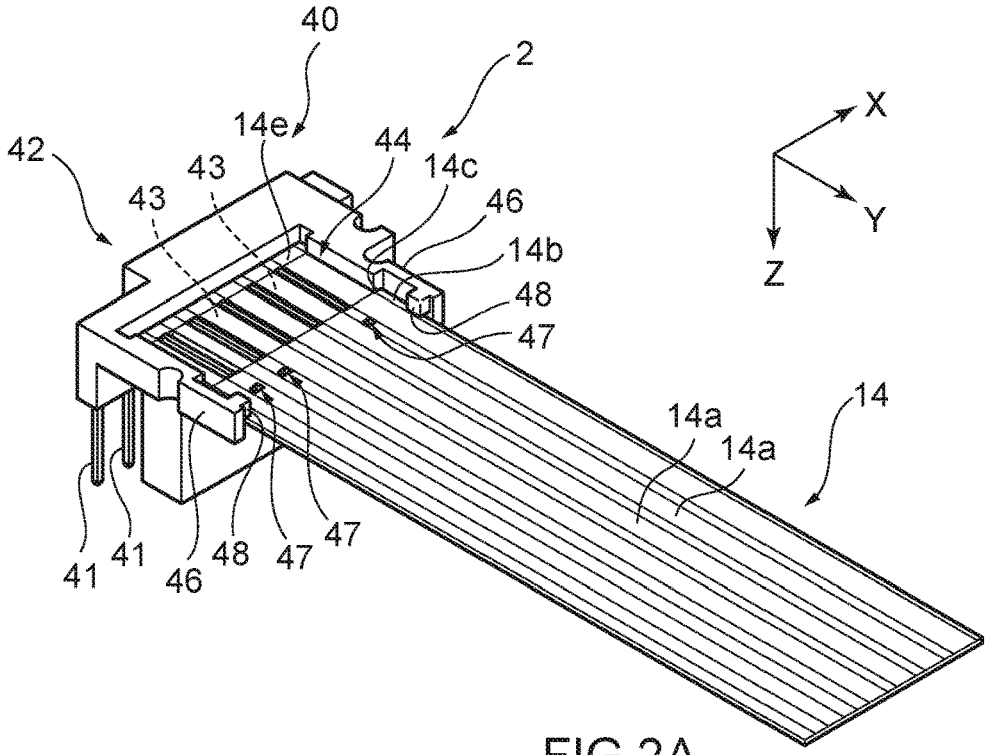
Figure 2B:
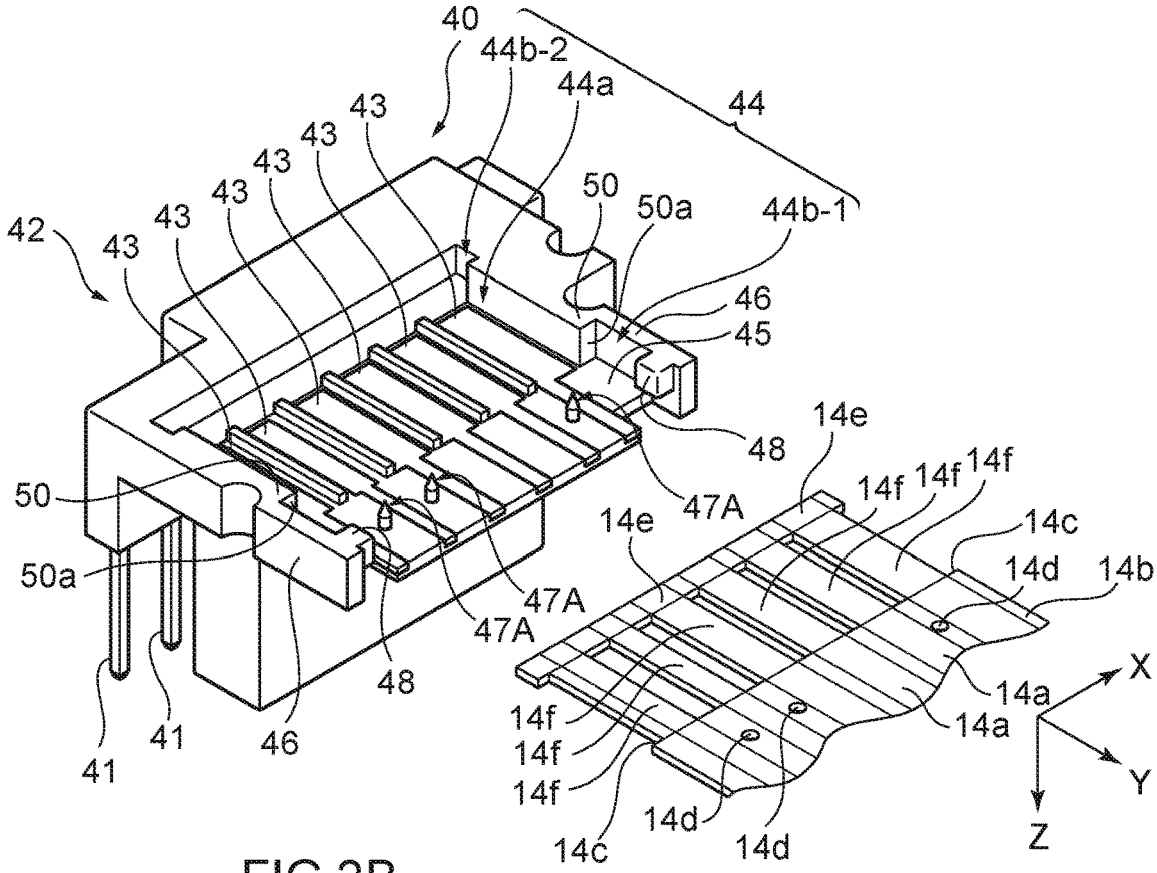

FIG. 1 is a perspective view schematically illustrating a rotary connector device that includes a flexible flat cable connection structure (hereinafter, referred to as an FFC connection structure) according to the present embodiment. Note that the rotary connector device in FIG. 1 and the FFC connection structure, which will be described later, in FIGS. 2A and 2B are given only as an example, and the structure of each of the rotary connector device and the FFC connection structure according to the embodiment is not limited to those illustrated in FIGS. 1, 2A and 2B.

In FIG. 1, a rotary connector device 1 includes a rotator 12, a stator 13 that holds the rotator 12 rotatably around an axis line x and forms an annular space S1 around the axis line x between the rotator 12 and the stator 13, and a flexible flat cable 14 (hereinafter, referred to as an FFC) that is accommodated in the annular space S1. In a vehicle, the stator 13 is fixed to the vehicle body of the vehicle, and the rotator 12 is attached to the steering wheel.

The rotator 12 includes an annular rotator main body 21 that is provided around the axis line x (the direction of the arrow A and the direction of the arrow B in FIG. 1), and a rotator side connector housing section 22 that allows the annular space S1 and the outside to communicate with each other and defines a rotator side connector housing space S2.

The rotator main body 21 includes a top plate 21*a* that has a hollow disc shape or a substantially hollow disc shape centered on the axis line x, and a cylindrical portion 21*b* that extends from the end portion of the top plate 21*a* on the inner circumferential side toward the annular space S1 side along the axis line x. The top plate 21*a* defines a portion of the rotary connector device 1 that faces upward (the direction of the arrow C in FIG. 1). The cylindrical portion 21*b* is formed so as to be rotatably engaged with the corresponding portion of the stator 13 with respect to the axis line x.

The stator 13 includes a stator main body 31 that has an annular shape or a substantially annular shape centered on the axis line x and has an engagement hole (not illustrated) having a circular shape centered on the axis line x, and a stator side connector housing section 32 that forms a stator side connector housing space S3.

The engagement hole formed in the stator main body 31 is formed so as to be able to house the lower end portion (the direction of arrow D in FIG. 1) of the cylindrical portion 21*b* of the rotator 12 and engage with this end portion. The rotator 12 is rotatably engaged with the engagement hole of the stator main body 31 of the stator 13 at the lower end portion of the cylindrical portion 21*b*, and in this way the rotator 12 is rotatably held by the stator 13.

As the rotator 12 is attached to the stator 13 as described above, the annular space S1 is defined by the top plate 21*a* and the cylindrical portion 21*b* of the rotator 12, and also by the stator main body 31 of the stator 13.

The FFC 14 is wound within the annular space 51 so as to include a slack having an appropriate length, the length of the slack varying with rotation of the rotator 12 with respect to the stator 13. A plurality of FFCs 14 can be held within the annular space S1 in a state where they are always aligned so as to follow the variation in the length of the slack.

An end portion of the flexible flat cable 14 is pulled out of the annular space S1, and is inserted into the rotator side connector housing space S2 of the rotator side connector housing section 22. In addition, the rotator side connector housing section 22 includes a rotation-side terminal insertion hole 22*a* into which the terminal of the cable pulled out of an electrical component (for example, a horn switch, an airbag module, and the like) of the steering wheel is allowed to be inserted. The terminal of the cable and a conductor portion of the FFC 14 are connected through the FFC connection structure (not illustrated) that is disposed in the rotator side connector housing space S2 of the rotator side connector housing section 22.

An end portion of the FFC 14 pulled out of the annular space S1 is inserted into the stator side connector housing space S3 of the stator side connector housing section 32, as with the rotator side connector housing space S2 described above. In addition, the stator side connector housing section 32 includes a fixed-side terminal insertion hole (not illustrated) into which a terminal having a predetermined shape and connected to a wire harness that forms an electric circuit on the vehicle body side is allowed to be inserted. This terminal and a conductor portion of the FFC 14 are connected through the FFC connector 40 that is disposed in the stator-side connector housing space S3 of the stator side connector housing section 32. This FFC 14 and the FFC connector 40 form the FFC connection structure, which will be described later.

This configuration enables electrical components on the steering wheel side, such as an airbag module, and the electric circuit on the vehicle body side to be electrically connected with the FFC 14 therebetween.

Figure 3A:
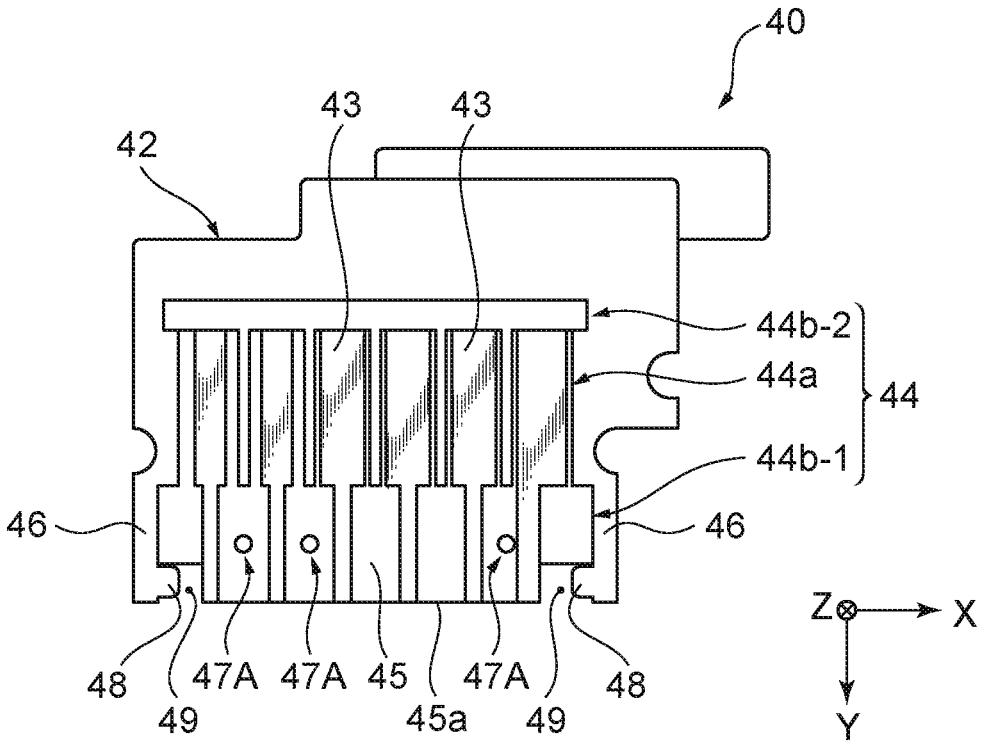
Figure 3B:
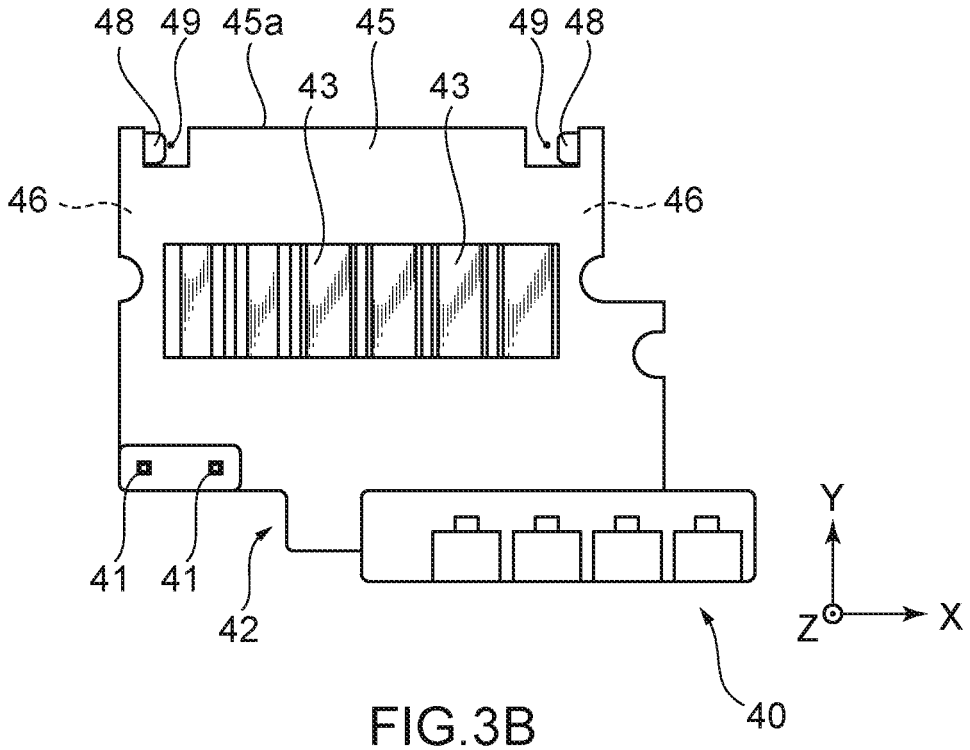
Figure 4A:
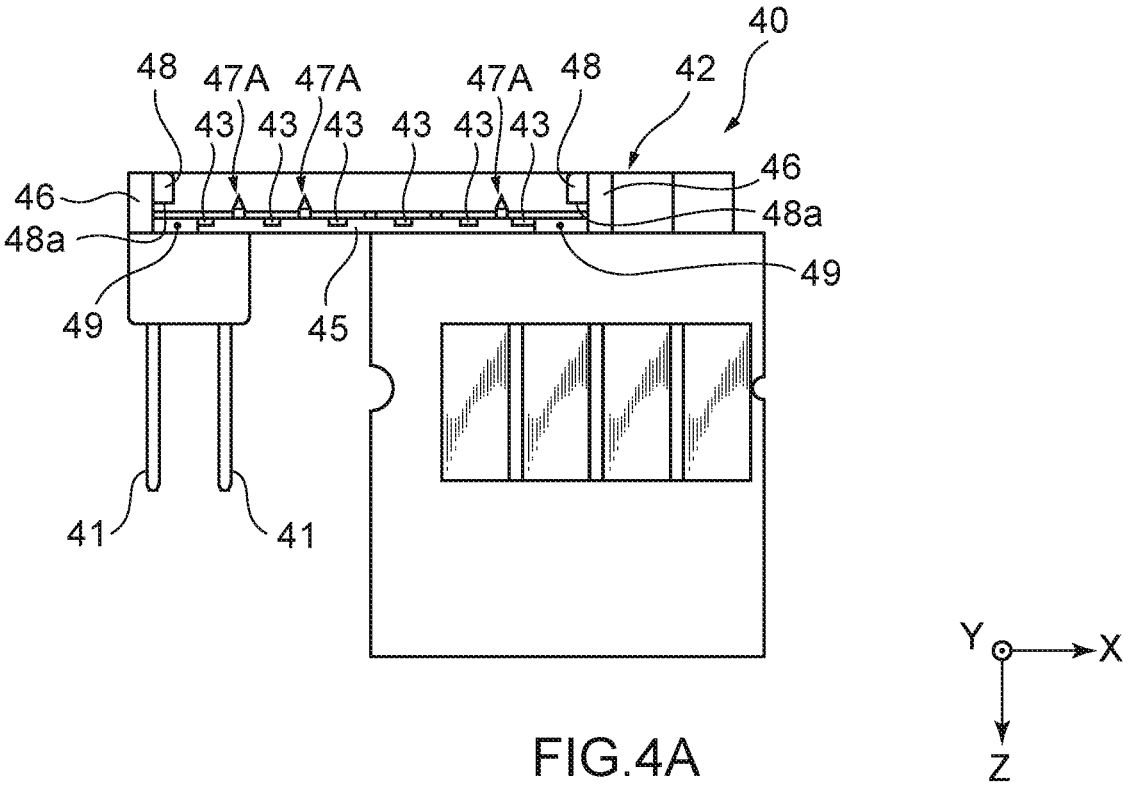
Figure 4B:
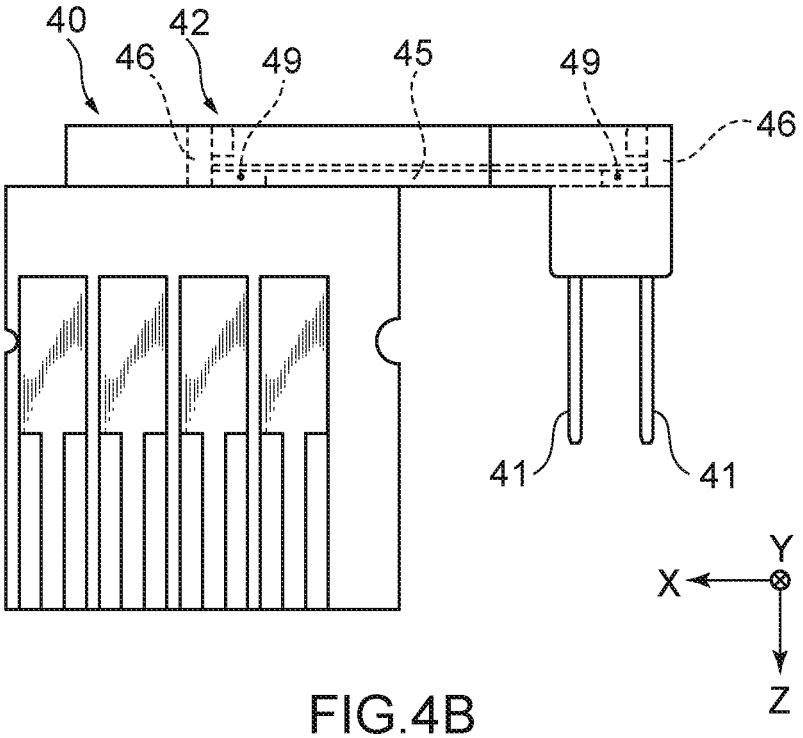
Figure 5A:
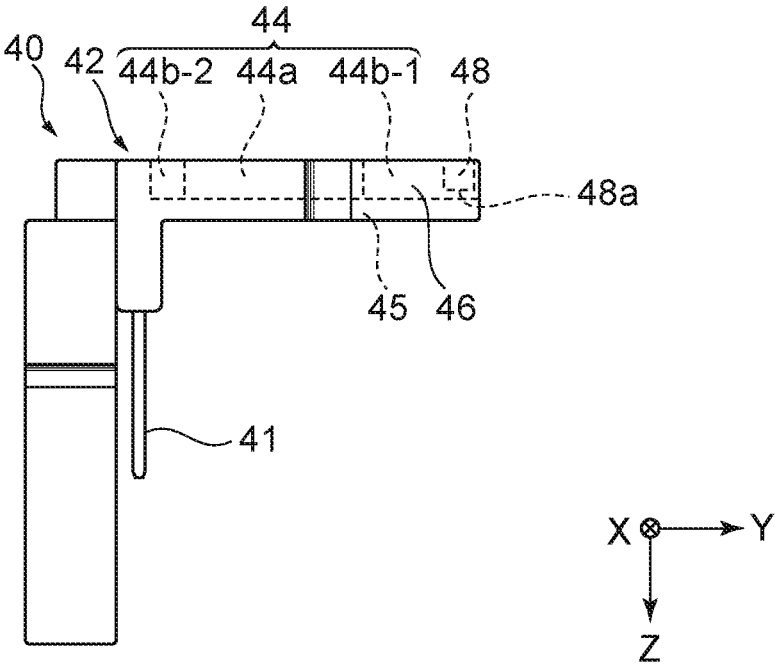
Figure 5B:
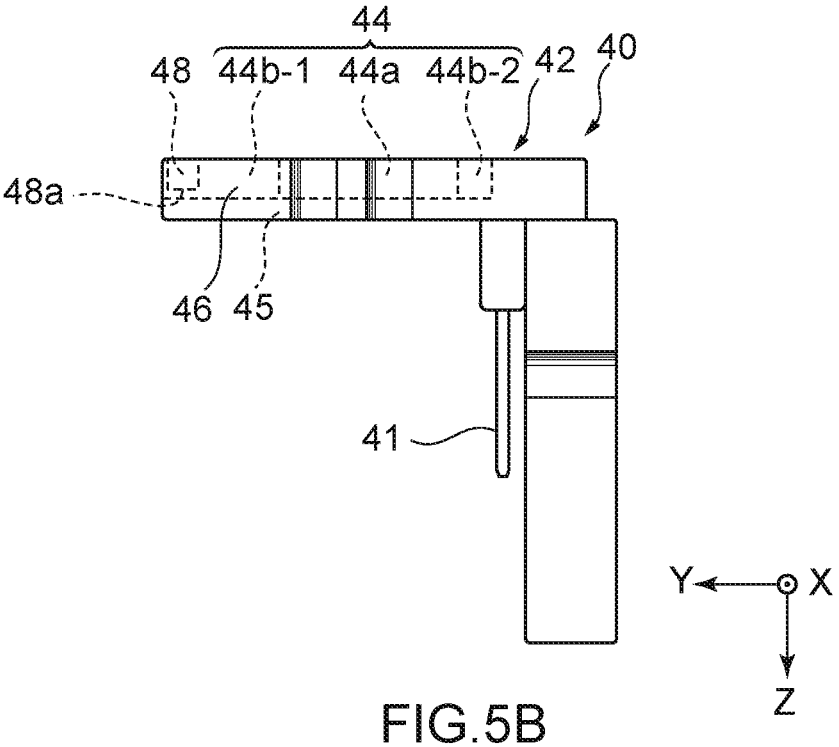

FIGS. 2A and 2B are perspective views illustrating the configuration of the FFC connection structure illustrated in FIG. 1, in which FIG. 2A illustrates a state where the FFC 14 is connected to the FFC connector 40, and FIG. 2B illustrates a state before the FFC 14 is connected. In addition, FIG. 3A is a plan view illustrating the FFC connector 40; FIG. 3B is a bottom view; FIG. 4A is a front view; FIG. 4B is a rear view; FIG. 5A is a left-side view; and FIG. 5B is a right-side view.

The FFC connection structure 2 includes the FFC 14 and the FFC connector 40 that electrically connects the FFC and the outside together, as illustrated in FIG. 2A.

The FFC connector 40 has a substantially L-shape in cross section that extends in the Y-direction and the Z-direction in the drawings and includes a plurality of busbars 41 made of metal and a busbar case 42 made of resin and holding the busbars so that part of the busbars 41 is exposed, and a terminal portion 43 where part of the busbars 41 is exposed is configured so as to be able to be electrically connected with a conductor portion 14*a* of the FFC 14.

The busbar case 42 includes: a recessed portion 44 that accommodates an end portion 14*b* of the FFC 14 in the length direction thereof; a bottom wall 45 provided on the recessed portion 44; paired side walls 46, 46 disposed at both ends of the recessed portion 44 while facing each other in the width direction of the FFC 14; a plurality of protruding portions 47, 47, . . . provided on the bottom wall 45 and inserted respectively into a plurality of holes 14*d*, 14*d*, . . . provided in the FFC 14; and paired projections 48, 48 that extend from the paired side walls 46, 46, face each other, and are spaced apart from the bottom wall 45.

In a state before the FFC is connected, the FFC connector 40 includes a plurality of protruding portions 47A, 47A, . . . provided on the bottom wall 45 and each having a shape different from that of each of the plurality of protruding portions 47, 47, . . . , as illustrated in FIG. 2B. The plurality of protruding portions 47A, 47A, . . . each have, for example, a columnar shape or conical shape or a combination thereof, and when the FFC 14 is connected to the FFC connector 40, the upper portions of the plurality of protruding portions 47A, 47A, . . . are melted and solidified to be welded to the FFC 14, whereby the plurality of protruding portions 47A, 47A, . . . are deformed to form the plurality of protruding portions 47, 47, . . . . The shapes of the plurality of protruding portions 47, 47, . . . after welding will be described later. Note that, in a state before connection of the FFC, the configurations other than the protruding portions of the FFC connector 40 are the same as those of the FFC connector in the FFC connection structure 2.

The recessed portion 44 is a shallow recess provided in the busbar case 42, and part of the plurality of busbars 41, 41, . . . is exposed from the bottom wall 45 to form the plurality of terminal portions 43, 43, . . . . The recessed portion 44 has a substantially I-shape in a plan view (FIG. 3A), and includes a narrow portion 44*a*, and wide portions 44*b*-1, 44*b*-2 each having a width wider than that of the narrow portion 44*a* and substantially equal to the width of the FFC 14. The wide portion 44*b*-1 is formed on the front side from the narrow portion 44*a* in the insertion direction of the FFC 14, whereas the wide portion 44*b*-2 is formed on the back side from the narrow portion 44*a* in the insertion direction of the FFC 14.

Paired notch portions 49, 49 are provided in the bottom wall 45 and disposed below the paired projections 48, 48 in a Z-direction perpendicular to an in-plane direction (X-Y plane direction) of the FFC 14 (FIGS. 4A and 4B). In the present embodiment, the paired notch portions 49, 49 each have a substantially rectangular shape in a plan view (FIG. 3B), are formed at both ends of the bottom wall 45 in the width direction (X-direction) of the FFC 14, and are formed in an end surface 45*a* of the bottom wall 45 in the length direction (Y-direction) of the FFC 14. In addition, the paired notch portions 49, 49 are disposed directly below the paired projections 48, 48 in a front view and spaced apart from the paired projections 48, 48 (FIG. 4A). The paired notch portions 49, 49 enable the end portion 14*b* of the FFC 14 to be inserted from under the bottom wall 45 through the paired notch portions 49, 49 to above the bottom wall 45 when the FFC 14 is fixed.

The paired side walls 46, 46 are provided with paired stepped portions 50, 50 each setting the position of a corner 14*c* of the FFC 14 (FIG. 2B). The stepped portion 50 includes a corner portion 50*a* formed at a boundary between the narrow portion 44*a* and the wide portion 44*b*-1 of the recessed portion 44. When the FFC 14 is fixed, this corner portion 50*a* is brought into contact with the corner 14*c* of the end portion 14*b* of the FFC 14 to position the FFC 14 in the length direction. The corner portion 14*c* differs from the corner portion of a length-direction end portion 14*e* of the FFC 14, and is a portion formed inward from a conductor exposure section 14*f* in the length direction, which will be described later, as a result of formation of the conductor exposure section 14*f*.

The projection 48 is a portion that has a substantially cuboid shape and projects inwardly from the inner side surface of the side wall 46, and has a substantially square shape when viewed from the side surface (FIGS. 5A and 5(*b*)). In addition, the projection 48 is formed at the end portion of the side wall 46 in the Y-direction, and is formed directly above the notch portion 49 in the Z-direction. In a state where the FFC 14 is fixed, the FFC 14 is disposed between the bottom wall 45 and the projection 48, and paired lower surfaces 48*a*, 48*a* of the paired projections 48, 48 function as a restriction surface that restricts movement of the FFC 14 in the Z-direction.

Figure 6A:
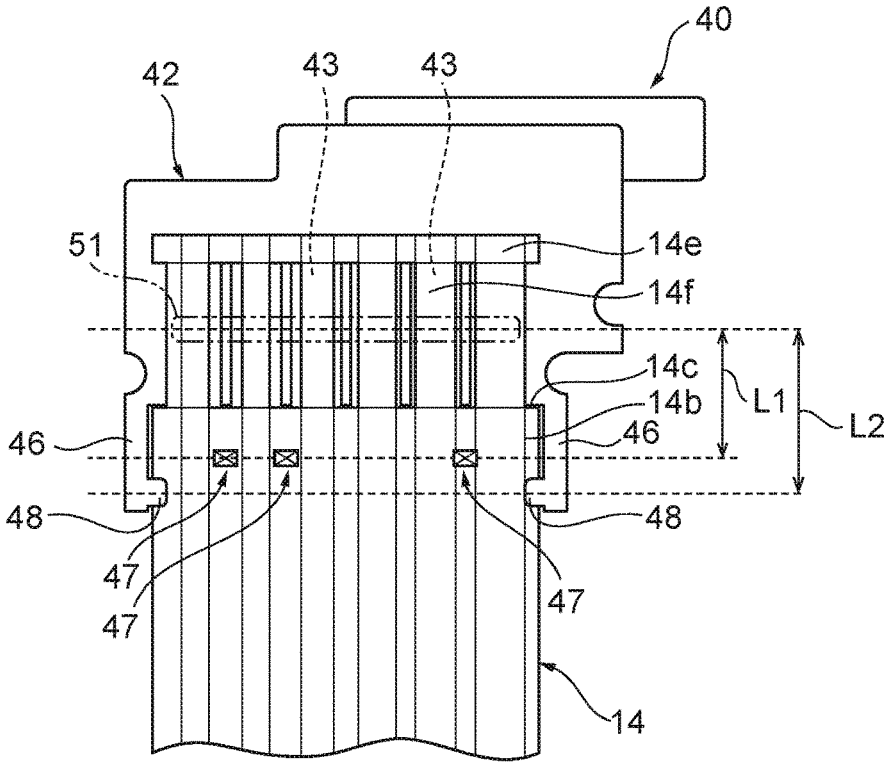
FIG. 6A is a diagram for illustrating a positional relationship between protruding portions and paired projections in the flexible flat cable connection structure illustrated in FIG. 2A.
Figure 6B:
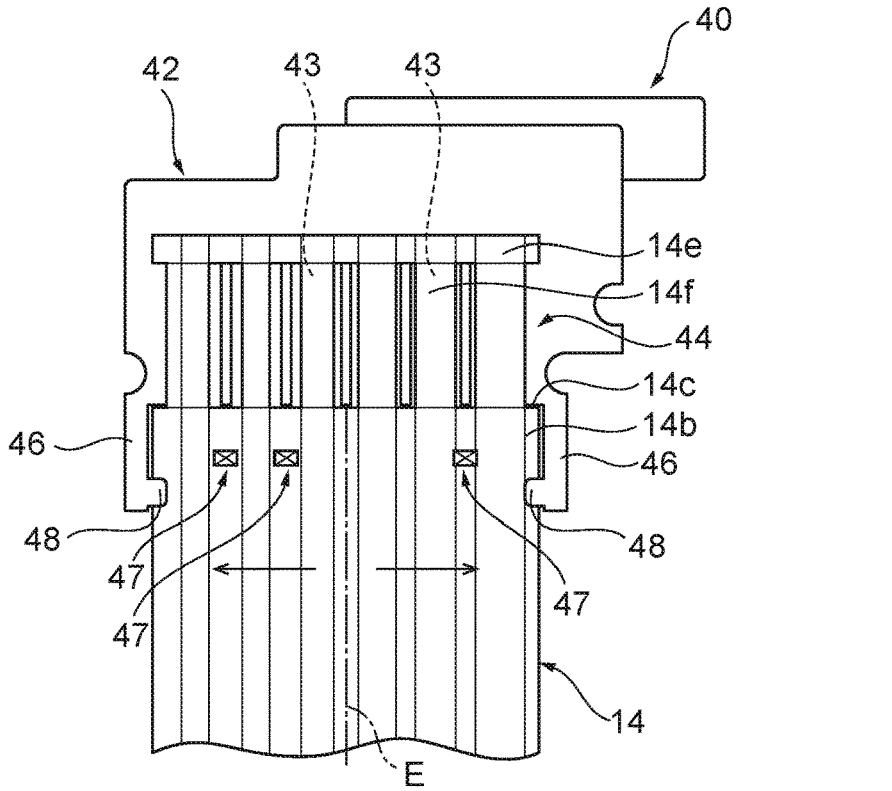
FIG. 6B is a diagram for illustrating arrangement of the protruding portions.

FIG. 6A is a diagram for illustrating the positional relationship between the protruding portions 47 and the paired projections 48, 48 in the FFC connection structure 2 illustrated in FIG. 2B, and FIG. 6B is a diagram for illustrating arrangement of the protruding portions 47.

As illustrated in FIG. 6A, the FFC connection structure 2 includes a welded portion 51 that extends in the width direction of the FFC 14 and connects the end portion of the FFC 14 and the bottom wall 45 together. The welded portion 51 is a portion that is formed by emitting ultrasound, laser light or the like onto a portion where the conductor portion 14*a* of the FFC and the terminal portion 43 overlap with each other.

The plurality of protruding portions 47, 47, . . . are disposed closer to the welded portion 51 than the plurality of protruding portions 48, 48 in the length direction of the FFC 14. In other words, in the FFC connection structure 2, the welded portion 51, the protruding portions 47, and the projection 48 are arranged so as to satisfy the relationship of $L1 \leq L2$, where L1 is the distance in the length direction of the FFC 14 between the position where the welded portion 51 is disposed and the position where the protruding portion 47 is disposed, and L2 is the distance between the position where the welded portion 51 is disposed and the position where the projection 48 is disposed.

Furthermore, the plurality of protruding portions 47, 47, . . . are disposed at asymmetrical positions with respect to the center line E in the width direction of the FFC 14 as illustrated in FIG. 6B, and in the present embodiment, two are disposed on one side of the center line E in the width direction whereas one is disposed on the other side. Note that, in the case where the FFC 14 has a shape symmetrical with respect to the center line E in the width direction, the plurality of protruding portions 47, 47, . . . may be disposed at symmetrical positions with respect to the center line E in the width direction of the FFC 14.

Figure 7A:
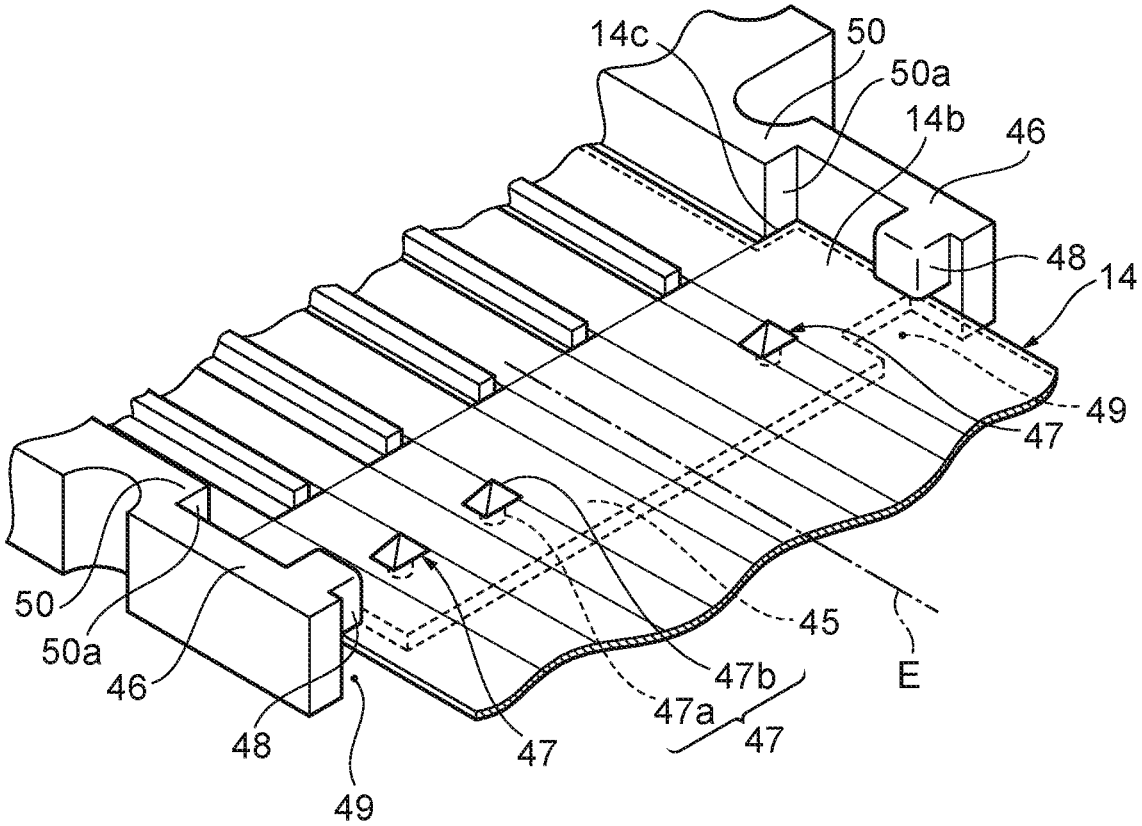

More specifically, as illustrated in FIG. 7A, the plurality of protruding portions 47, 47, . . . each include a base portion 47*a* provided integrally with the bottom wall 45, and a flat expanding portion 47*b* provided integrally with the base portion at the upper portion of this base portion and expanding in the width direction of the FFC 14. In the present embodiment, the plurality of protruding portions 47, 47, . . . includes three protruding portions aligning in one line along the width direction of the FFC 14, and each have, for example, an arrowhead shape. In addition, the plurality of flat expanding portions 47*b*, 47*b*, . . . of the plurality of protruding portions 47, 47, . . . each have the same rectangular shape in a plan view of the bottom wall 45.

The FFC 14 has a laminate structure in which a plurality of conductor portions 14*a* including a copper foil or including a copper foil and a plating layer are disposed between two insulating films made of resin such as PET with an adhesive layer therebetween (see FIG. 2B). In a state before the FFC is connected, this FFC 14 includes a plurality of holes 14*d*, 14*d*, . . . provided at positions respectively corresponding to the plurality of protruding portions 47A, 47A, . . . , in other words, at asymmetrical positions with respect to the center line E in the width direction of the FFC 14. The plurality of holes 14*d*, 14*d*, . . . are formed in the layered portion where no conductor portion 14*a* is provided. With this configuration, the front and back of the FFC 14 are defined in a case that the FFC 14 is fixed to the FFC connector 40. In addition, in a state after the FFC is connected, the plurality of protruding portions 47, 47, . . . are welded to the FFC 14 in a state of being passed respectively through the plurality of holes 14*d*, 14*d*, . . . .

Figure 7B:
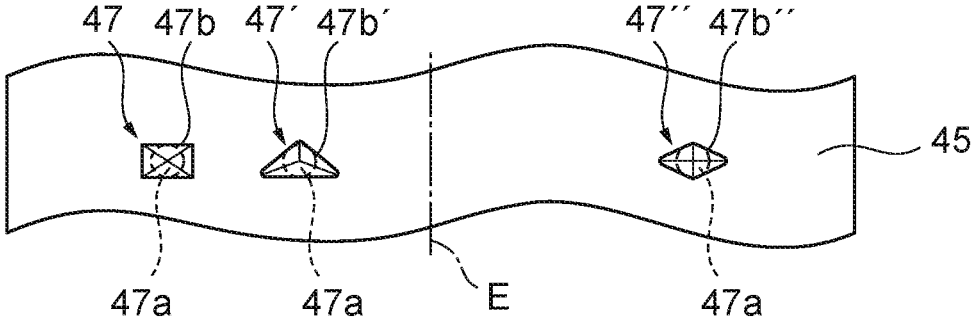

The plurality of protruding portions 47, 47, . . . may have shapes different from each other in a plan view of the bottom wall 45, as illustrated in FIG. 7B. For example, the flat expanding portions 47*b*, 47*b*', 47*b*" . . . of the plurality of protruding portions 47, 47', 47" may have a rectangular shape, a triangle shape, and a rhombus shape, respectively, in a plan view of the bottom wall 45. In this case, the plurality of protruding portions 47, 47, . . . may be disposed at asymmetrical positions with respect to the center line E in the width direction of the FFC 14 as illustrated in the same drawing, or may be disposed at symmetrical positions with respect to the center line E in the width direction. In other words, the plurality of protruding portions 47, 47, . . . may be disposed at asymmetrical positions with respect to the center line E in the width direction of the FFC 14, or may have shapes different from each other in a plan view of the bottom wall 45, or may be disposed at symmetrical positions and have shapes different from each other.

Next, the method for connecting the FFC 14 to the FFC connector 40 configured as described above will be described.

First, laser is emitted onto the end portion 14*b* of the FFC 14 to burn and remove the resin layer that forms the laminate structure of the FFC 14, and the conductor exposure section 14*f* from which the conductor portion 14*a* of the laminate structure is exposed is formed (FIG. 2B). Then, as illustrated in the cross-sectional view of FIG. 8A, both ends of the FFC 14 in the width direction are pressed to curve the FFC 14, and the end portion 14*b* of the FFC 14 is caused to pass through the wide portion 44*b*-1 of the recessed portion 44 from the end surface 45*a* side of the bottom wall 45. At this time, the end portion 14*b* of the FFC 14 is inserted diagonally with respect to the in-plane direction (X-Y planar direction) of the bottom wall 45 so that the FFC 14 is disposed below the paired projections 48, 48 and above the plurality of protruding portions 47A, 47A, . . . . At the time of insertion, both width-direction end portions of the curved FFC 14 are caused to pass respectively through the paired notch portions 49, 49 of the paired side walls 46, 46, whereby the end portion 14*b* of the FFC 14 can be easily inserted into the recessed portion 44 with the FFC 14 remaining in the bent state.

Next, at a position where the corner portion 14*c* of the FFC 14 is brought into contact with the corner portion 50*a* of the stepped portion 50, the FFC 14 is moved so that the in-plane direction of the FFC 14 is substantially parallel to the in-plane direction of the bottom wall 45, and the end portion 14*b* of the FFC 14 is accommodated in the recessed portion 44. At this time, the length-direction end portion 14*e* of the FFC 14 is accommodated in the wide portion 44*b*-2. In addition, the plurality of protruding portions 47A, 47A, . . . are caused to pass through the plurality of holes 14*d*, 14*d*, . . . of the FFC 14 to bring the end portion 14*b* of the FFC 14 into contact with the bottom wall 45. As a result, both width-direction end portions of the FFC 14 are incorporated between the bottom wall 45 and the paired projections 48, 48.

At this time, movement of the end portion 14*b* of the FFC 14 in the length direction (Y-direction) of the FFC 14 is restricted by the plurality of protruding portions 47A, 47A, . . . and the stepped portion 50, and movement thereof in the width direction (X-direction) is also restricted by the plurality of protruding portions 47, 47, . . . and the paired side walls 46, 46. In addition, movement of the end portion 14*b* of the FFC 14 in the thickness direction (Z-direction) is restricted by the plurality of protruding portions 47, 47 and paired projections 48, 48. This fixes the end portion 14*b* of the FFC 14 to the FFC connector 40, thereby preventing the FFC 14 from detaching from the FFC connector 40. Furthermore, the end portion 14*b* of the FFC 14 is positioned in a highly precise manner relative to the bottom wall 45, and the conductor portion 14*a* of the FFC 14 and the terminal portion 43 of the bottom wall 45 are positioned in a highly precise manner.

Figures 8A, 8B, 8C, 8D:
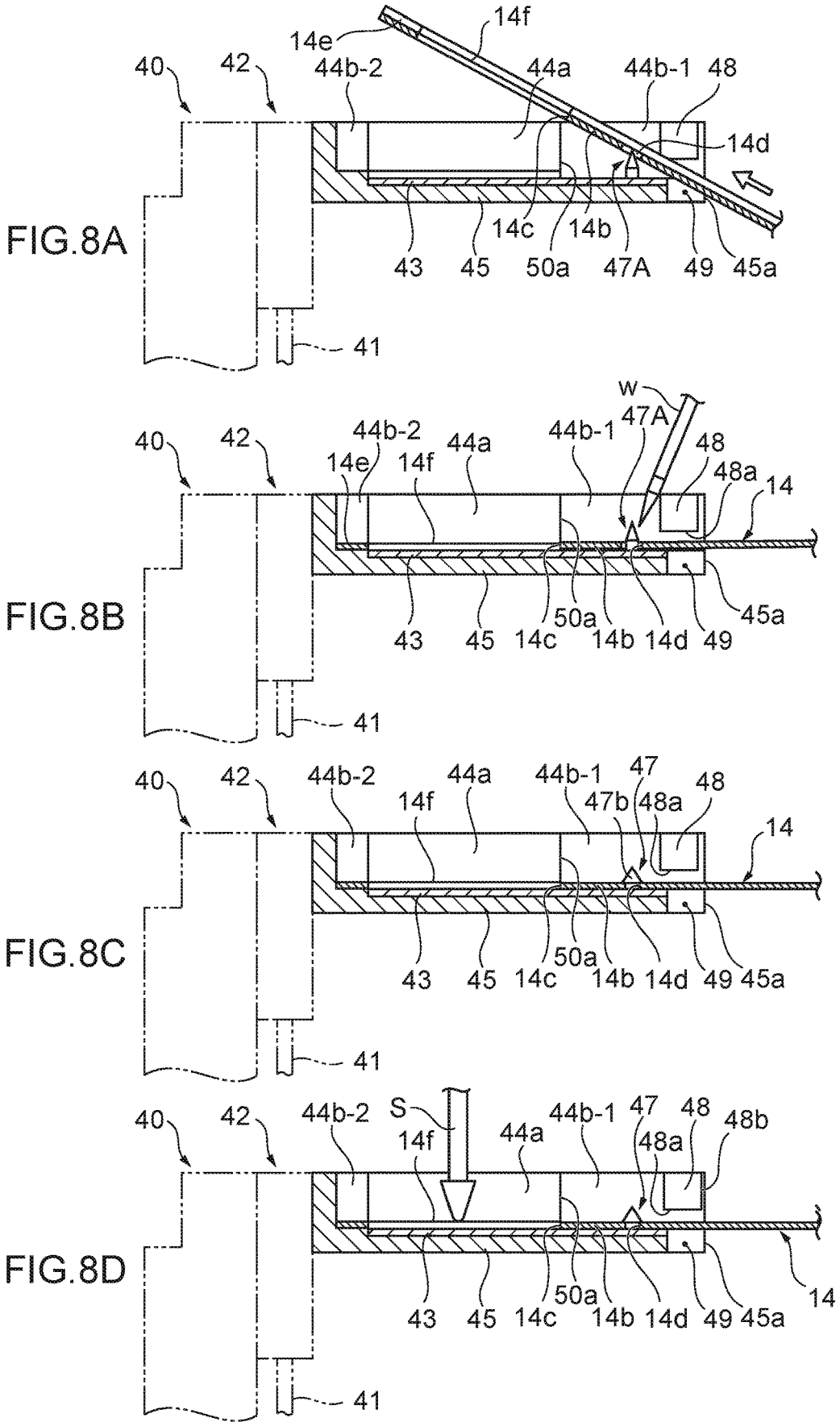
FIGS. 8A to 8D are diagrams for illustrating steps for connecting the flexible flat cable to the flexible flat cable connector illustrated in FIG. 2B.

Next, the protruding portions 47A are melted with a welder W in a state where the plurality of protruding portions 47A, 47A, . . . are passed through the plurality of holes 14*d*, 14*d*, . . . of the FFC 14 (FIG. 8B), whereby the protruding portions 47 each having the flat expanding portion 47*b* are formed, and the protruding portions 47 and the insulating film of the FFC 14 are welded (FIG. 8C).

After this, as illustrated in FIG. 8D, a tool S is pressed from the conductor exposure section 14*f* onto a portion where the conductor exposure section 14*f* of the FFC 14 and the terminal portion 43 of the busbars 41 overlap with each other, ultrasound is applied to the tool S to weld the conductor exposure section 14*f* and the terminal portion 43 to form the welded portion 51, thereby connecting the conductor portion 14*a* and the terminal portion 43 together. Instead of ultrasonic welding, the conductor portion 14*a* and the terminal portion 43 may be connected through resistance welding or laser welding. This enables the FFC 14 and the FFC connector 40 to be connected together.

Figure 9A:
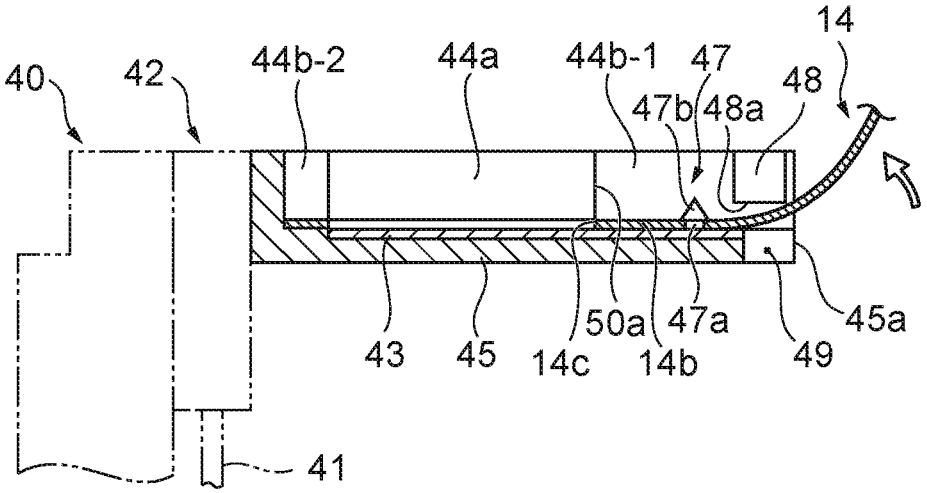
FIGS. 9A and 9B are cross-sectional views each illustrating a state where the flexible flat cable receives an external force after the flexible flat cable is connected.
Figure 9B:
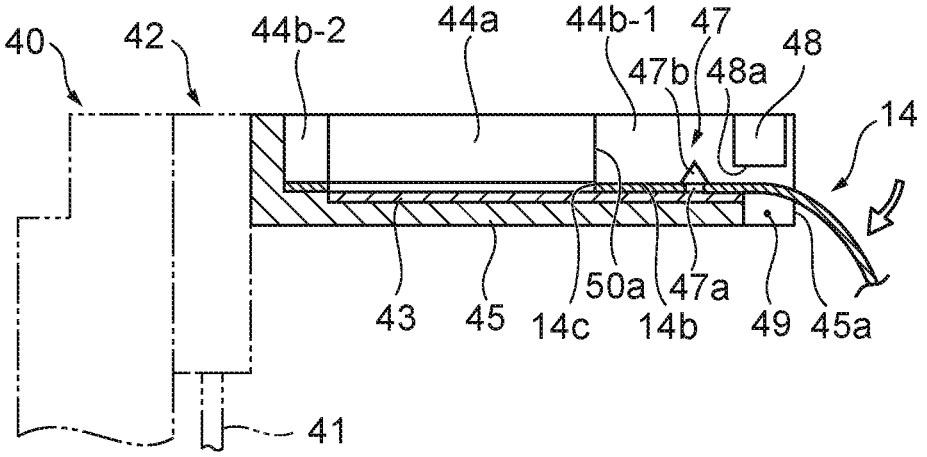

In the case of the FFC connection structure 2 configured as described above, in a case where the FFC 14 receives an external force in the arrowed direction (mainly in the Z-direction) as illustrated in FIG. 9A or 9B, the FFC 14 may move in the Z-direction, in other words, in a direction away from the bottom wall 45. At this time, movement in the Z-direction is restricted by the plurality of protruding portions 47, 47, . . . and the paired projections 48, 48, and the FFC 14 is prevented from detaching from the FFC connector 40 to maintain the connection between the FFC 14 and the FFC connector 40.

In addition, in FIG. 9A or 9B, in a case where the protruding portion 47 receives stress from the FFC 14, stress concentration occurs at a boundary (neck portion) between the base portion 47*a* and the flat expanding portion 47*b* of the protruding portion 47. In the present embodiment, since the flat expanding portion 47*b* is not expanded in the length direction (Y-direction) of the FFC 14, it is possible to reduce tensile stress or compressive stress in the Z-direction occurring at the boundary between the base portion 47*a* and the flat expanding portion 47*b*, thereby preventing the protruding portions 47 from breaking.

Figure 9C:
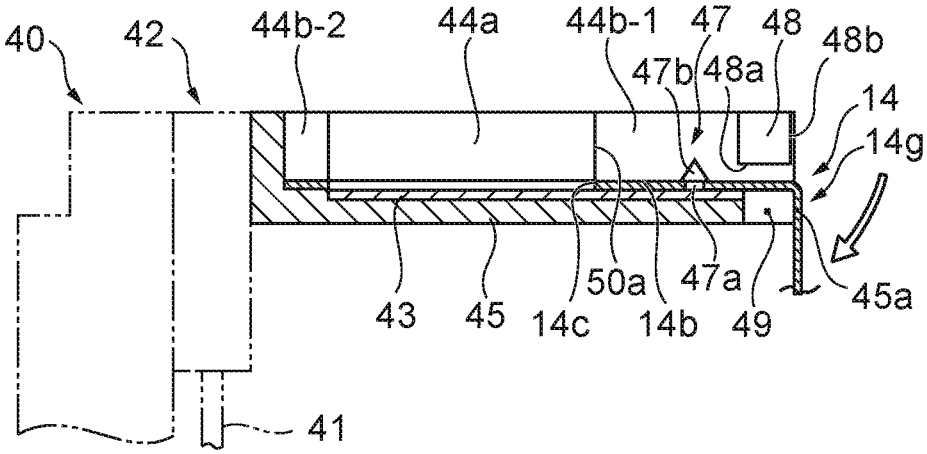
FIG. 9C is a cross-sectional view for illustrating a step for forming a bent portion of the flexible flat cable.

In addition, in the connecting method, it may be possible to perform a bent-portion forming step in which a bent portion 14 *g* is formed in the FFC 14 as illustrated in FIG. 9C, after the incorporating step or welding step between the FFC 14 and the FFC connector 40. The bent portion 14 *g* is provided on an opposite side of the paired projections 48, 48 to the protruding portions 47 in the length direction of the FFC 14. This prevents the external force from being transmitted to the welded portion 51 side, which makes it possible to prevent the welded portions between the FFC 14 and the protruding portions 47 from breaking.

In the bent-portion forming step, for example, the FFC 14 is bent downward while being pressed and contacted to the end surface 45*a* of the bottom wall 45 (FIG. 9C). Preferably, the end surface 45*a* is a face perpendicular to the in-plane direction (X-Y planar direction) of the bottom wall 45, and the bent portion 14 *g* having a substantially L-shape in cross section can be formed by pressing and contacting the FFC 14 to the end surface 45*a* having the same shape. As described above, by using the end surface 45*a* of the bottom wall as a supporting surface for the FFC 14 in the bent-portion forming step, it is possible to perform bending process to the FFC 14. Thus, even in a case where the FFC 14 receives stress that may cause deformation in a peeling-off direction from the bottom wall 45, it is possible to easily bend the FFC 14 free from peeling-off without using any extra equipment.

As described above, according to the present disclosure, in the FFC connector 40 (FIG. 2B), the plurality of protruding portions 47A, 47A, . . . are provided on the bottom wall 45 of the recessed portion 44. The paired projections 48, 48 extend from the paired side walls 46, 46, face each other, and are spaced apart from the bottom wall 45. Thus, the plurality of protruding portions 47A, 47A, . . . are caused to pass through the plurality of holes 14*d*, 14*d*, . . . provided in the FFC 14, and both width-direction end portions of the FFC 14 are incorporated between the bottom wall 45 and the paired projections 48, 48 With this configuration, movement of the FFC 14 in the length direction is restricted by the plurality of protruding portions 47A, 47A, . . . ; movement of the FFC 14 in the lateral direction is restricted by the plurality of protruding portions 47A, 47A, . . . and the paired side walls 46, 46; and movement of the FFC 14 in the thickness direction is restricted by the plurality of protruding portions 47A, 47A, . . . and the paired projections 48, 48, . . . . Thus, this configuration of the FFC connector 40 does not require two members, and hence, the FFC 14 can be fixed only by using one member, that is, the FFC connector 40. Furthermore, multiple steps in association with the two-member configuration are not necessary, and hence, fixing can be performed only through a series of simple steps. Thus, it is possible to easily connect the FFC 14, and provide a reliable connection.

Furthermore, the paired notch portions 49, 49 are provided in the bottom wall 45, and are disposed below the paired projections 48, 48 in the direction perpendicular to the in-plane direction of the FFC 14. When the FFC 14 is connected, the width direction end portions of the FFC 14 are caused to pass through the paired notch portions 49, 49. This enables the end portion of the FFC 14 to be easily incorporated into the wide portion 44*b* of the recessed portion 44, and also enables the FFC 14 to be easily fixed to the wide portion 44*b*.

In addition, the paired stepped portions 50, 50 are provided on the paired side walls 46, 46, and each restrict the position of the corner 14*c* of the FFC 14. This enables the FFC 14 to be positioned in place in the length direction in a precise and reliable manner, and also enables the plurality of protruding portions 47A, 47A to be easily passed through the plurality of holes 14*d*, 14*d*, . . . of the FFC 14.

In addition, the plurality of protruding portions 47A, 47A, . . . are disposed at asymmetrical positions with respect to the center line E in the width direction of the FFC 14. Thus, by providing the FFC 14 with the plurality of holes 14*d*, 14*d*, . . . at positions corresponding to the plurality of protruding portions 47A, 47A, . . . on a one-to-one basis or providing it with the plurality of holes 14*d*, 14*d*, . . . that correspond to the shapes of these protruding portions on a one-to-one basis, it is possible to prevent the wrong side of the FFC 14 from being fixed.

Furthermore, in the FFC connection structure 2 (FIG. 2A), the welded portion 51 extends in the width direction of the FFC 14 and allows the end portion 14*b* of the FFC 14 and the bottom wall 45 to be connected together. The plurality of protruding portions 47, 47, . . . are disposed closer to the welded portion 51 than the paired projections 48, 48 in the length direction of the FFC 14. Thus, the FFC 14 can be easily positioned in place when the welded portion 51 is formed.

In addition, the plurality of protruding portions 47, 47, . . . are disposed at asymmetrical positions with respect to the center line E in the width direction of the FFC 14, or have shapes different from each other. Thus, by providing the FFC 14 with the plurality of holes 14*d*, 14*d*, . . . at positions corresponding to the plurality of protruding portions 47, 47, . . . , it is possible to prevent the wrong side of the FFC 14 to be fixed.

Furthermore, the protruding portion 47 includes the flat expanding portion 47*b* that expands in the width direction of the FFC 14. Thus, when the FFC 14 bends in the length direction thereof and moves in a direction away from the bottom wall 45, the FFC 14 is pressed and contacted to the flat expanding portion 47*b*, and hence, the movement can be restricted by the flat expanding portion 47*b*. In addition, the flat expanding portion 47*b* does not expand in the length direction of the FFC 14. This enables stress received from the FFC 14 to be reduced, and also can prevent the protruding portion 47 from breaking. Thus, it is possible to maintain the reliable fixation of the FFC 14 for a long period of time.

Furthermore, when achieving a further size reduction of the rotary connector device 1, it is possible to eliminate the need for a complex assembly process in which a very small mold cover is attached to a primary mold member, and hence, it is possible to provide a reliable connection while achieving an easy connection with the FFC.

These are description of the FFC connector, the FFC connection structure, and the rotary connector device according to the present embodiment. However, the embodiment is not limited to the embodiment described above, and various modifications and changes are possible on the basis of the technical concept of the present disclosure.

For example, the embodiment is described in which the FFC connector 40 is accommodated in the stator side connector housing section 32. However, the configuration is not limited to this, and a FFC connector that is accommodated in the rotator side connector housing section 22 may have a structure similar to that of the FFC connector 40.

The FFC connector 40 is a member having a substantially L-shape in cross section. However, the shape is not limited to this, and it may be a member having a straight shape.

In addition, the number of busbars 41, the number of terminal portions 43, or the number of conductor portions 14*a* of the FFC 14 is not limited to those described in the present embodiment, and needless to say, these numbers may be changed to other numbers depending on applications or specifications.

Furthermore, although the bent portion 14 *g* has a one-mountain shape, the shape is not limited to this, and it may be possible to employ a shape having multiple mountain portions or valley portions such as a substantially W-shape in cross section. This enables an external force applied to the FFC 14 to be more absorbed.

The plurality of holes 14*d*, 14*d*, . . . are formed in the layered portion where no conductor portion 14*a* is provided. However, the configuration is not limited to this, and these holes may be formed in the layered portion where the conductor portion 14*a* is provided. In addition, part of the plurality of holes may be formed in the layered portion where no conductor portion 14*a* is provided whereas the remaining part may be formed in the layered portion where the conductor portion 14*a* is provided.

Furthermore, in the embodiment described above, the resin layer that forms the laminate structure of the FFC 14 is burnt and removed. However, the embodiment is not limited to this, and it may be possible to remove the resin layer through processing such as press machining.

In addition, in the embodiment described above, the upper portions of the plurality of protruding portions 47A, 47A, . . . are melted and solidified to be welded to the FFC 14, whereby the plurality of protruding portions 47A, 47A, . . . are deformed to form the plurality of protruding portions 47, 47, . . . . However, the embodiment is not limited to this, and it may be possible to deform the upper portions of the plurality of protruding portions 47A, 47A, . . . through pressing such as squashing to form the plurality of protruding portions 47, 47, . . . .

Furthermore, the configurations of the rotary connector device 1 other than the FFC connection structure 2 is not limited to those in the embodiment described above, and may have other shapes or structure.

What is claimed is:

1. A flexible flat cable connector configured to electrically connect a flexible flat cable and the outside together, comprising:

a recessed portion configured to accommodate an end portion of the flexible flat cable;

a bottom wall provided on the recessed portion;

paired side walls disposed at both ends of the recessed portion and facing each other in a width direction of the flexible flat cable, each of the paired side walls having a respective projection that is integrally formed, the respective projections being paired projections; and a plurality of protruding portions provided on the bottom wall and spaced from the paired side walls, wherein the plurality of protruding portions are inserted respectively into a plurality of holes provided in the flexible flat cable when the flexible flat cable is accommodated;

wherein the paired projections extend from the paired side walls, face each other, and are spaced apart from the bottom wall, and wherein the paired projections are configured to accommodate the flexible flat cable between the paired projections and the bottom wall and to restrict movement of the flexible flat cable in the opposite direction against the bottom wall when the flexible flat cable is accommodated.

2. The flexible flat cable connector according to claim 1, further comprising:

paired notch portions provided in the bottom wall and disposed below the paired projections in a direction perpendicular to an in-plane direction of the flexible flat cable.

3. The flexible flat cable connector according to claim 2, further comprising:

paired stepped portions provided on the paired side walls and configured to set a position of a corner portion of the flexible flat cable.

4. The flexible flat cable connector according to claim 1, further comprising:

paired stepped portions provided on the paired side walls and configured to set a position of a corner portion of the flexible flat cable.

5. The flexible flat cable connector according to claim 1, wherein the plurality of protruding portions are disposed at asymmetrical positions with respect to a center of the flexible flat cable in a width direction of the flexible flat cable.

6. The rotary connector device according to claim 1, wherein each of the paired projections extends from the respective paired side wall into the recessed portion that is configured to accommodate an end portion of the flexible flat cable.

7. A flexible flat cable connection structure comprising:

a flexible flat cable; and a flexible flat cable connector configured to electrically connect the flexible flat cable and the outside together, wherein the flexible flat cable connector includes a recessed portion configured to accommodate an end portion of the flexible flat cable, a bottom wall provided on the recessed portion, paired side walls disposed at both ends of the recessed portion and facing each other in a width direction of the flexible flat cable, each of the paired side walls having a respective projection that is integrally formed, the respective projections being paired projections, and a plurality of protruding portions provided on the bottom wall and spaced from the paired side wall, the plurality of protruding portions inserted respectively into a plurality of holes provided in the flexible flat cable, the plurality of holes spaced from side edges of the flexible flat cable, wherein the paired projections extend from the paired side walls, face each other, are spaced apart from the bottom wall, accommodate the flexible flat cable between the bottom wall and the paired projections, and restrict movement of the flexible flat cable in the opposite direction against the bottom wall.

8. The flexible flat cable connection structure according to claim 7, further comprising:

a welded portion extending in a width direction of the flexible flat cable and configured to connect the end portion of the flexible flat cable and the bottom wall together, wherein the plurality of protruding portions are disposed closer to the welded portion than the paired projections in a length direction of the flexible flat cable.

9. The flexible flat cable connection structure according to claim 8, wherein the plurality of protruding portions are disposed at asymmetrical positions with respect to a center of the flexible flat cable in a width direction of the flexible flat cable.

10. The flexible flat cable connection structure according to claim 9, wherein the plurality of protruding portions have shapes different from each other in a plan view of the bottom wall.

11. The flexible flat cable connection structure according to claim 8, wherein the plurality of protruding portions have shapes different from each other in a plan view of the bottom wall.

12. The flexible flat cable connection structure according to claim 7, wherein the plurality of protruding portions are disposed at asymmetrical positions with respect to a center of the flexible flat cable in a width direction of the flexible flat cable.

13. The flexible flat cable connection structure according to claim 12, wherein the plurality of protruding portions have shapes different from each other in a plan view of the bottom wall.

14. The flexible flat cable connection structure according to claim 7, wherein the plurality of protruding portions have shapes different from each other in a plan view of the bottom wall.

15. The flexible flat cable connection structure according to claim 7, wherein the plurality of protruding portions include a flat expanding portion expanding in a width direction of the flexible flat cable.

16. A rotary connector device comprising the flexible flat cable connection structure according to claim 7.

17. The flexible flat cable connection structure according to claim 7, wherein each of the paired projections extends from the respective paired side wall into the recessed portion that is configured to accommodate an end portion of the flexible flat cable.

* * * * *